US008562229B2

(12) United States Patent
Inaba et al.

(10) Patent No.: US 8,562,229 B2
(45) Date of Patent: Oct. 22, 2013

(54) PRINTING APPARATUS WITH CUTTER HAVING A BLADE INCLUDING A STEP PORTION

(75) Inventors: Takehiko Inaba, Obu (JP); Keiji Seo, Nagoya (JP); Shinji Kobayashi, Tokoname (JP); Atsushi Kasugai, Nagoya (JP); Akira Sago, Seto (JP); Tomohiko Sugino, Nagoya (JP); Sunao Masuda, Kiyosu (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 961 days.

(21) Appl. No.: 12/288,975

(22) Filed: Oct. 24, 2008

(65) Prior Publication Data

US 2009/0110461 A1 Apr. 30, 2009

(30) Foreign Application Priority Data

Oct. 26, 2007 (JP) ..... 2007-278736

(51) Int. Cl.
*B41J 11/70* (2006.01)
*B26D 1/08* (2006.01)

(52) U.S. Cl.
CPC ..... *B41J 11/703* (2013.01); *B26D 1/085* (2013.01); *Y10S 83/922* (2013.01)
USPC ..... 400/621; 83/694; 83/922

(58) Field of Classification Search
CPC .. B41J 11/70; B41J 11/703; B26D 2007/005; B26D 2007/082; B26D 2007/1809; B26D 1/085
USPC ..... 400/621; 83/139, 694, 922; 30/128, 308
IPC ..... B65H 1/08
See application file for complete search history.

(56) References Cited

U.S. PATENT DOCUMENTS

| | | | | |
|---|---|---|---|---|
| 5,468,081 | A * | 11/1995 | Cane et al. | 400/621 |
| 5,538,591 | A * | 7/1996 | Collins et al. | 156/759 |
| 6,145,561 | A | 11/2000 | Watanabe et al. | |
| 6,152,007 | A * | 11/2000 | Sato | 83/582 |
| 2001/0037712 | A1 | 11/2001 | Furuhata et al. | |
| 2006/0137827 | A1 | 6/2006 | Uneyama et al. | |
| 2007/0028739 | A1 * | 2/2007 | Kawaguchi | 83/651 |
| 2007/0296799 | A1 * | 12/2007 | Watanabe et al. | 347/222 |

FOREIGN PATENT DOCUMENTS

| | | | |
|---|---|---|---|
| EP | 1 179 400 | | 2/2002 |
| EP | 1714938 | A1 * | 10/2006 |
| FR | 889 444 | | 1/1944 |

(Continued)

*Primary Examiner* — Daniel J Colilla
(74) *Attorney, Agent, or Firm* — McCarter & English, LLP

(57) ABSTRACT

A printing apparatus includes a transfer mechanism that transfers a print medium, a printing device that prints on the print medium, a stationary blade that is provided on a downstream side in a transfer direction of the print medium further than the printing device to cut the print medium, a movable blade that is provided on a downstream side in a transfer direction of the print medium further than the printing device and that cut the print medium, and a step portion that is provided on a reverse face of the downstream blade which is located on downstream side in transferring of the print medium, the reverse face being reverse of a slide face of the downstream blade sliding on the upstream blade which is located on upstream side in transferring of the print medium, and that projects along a thickness direction of the downstream blade.

4 Claims, 16 Drawing Sheets

(56) References Cited

FOREIGN PATENT DOCUMENTS

| | | | | |
|---|---|---|---|---|
| GB | 1 352 677 | | | 5/1974 |
| JP | S43-020828 | | | 9/1968 |
| JP | H9-136290 | | | 5/1977 |
| JP | S52-099149 | | | 8/1977 |
| JP | S52-103954 | | | 8/1977 |
| JP | H08-011370 | | | 1/1996 |
| JP | H10-151279 | | | 6/1998 |
| JP | H10-175190 | | | 6/1998 |
| JP | 2000190280 | | | 7/2000 |
| JP | 2001293266 | A | * | 10/2001 |
| JP | 2001341370 | A | * | 12/2001 |
| JP | 2003-025274 | | | 1/2003 |
| JP | 3421634 | | | 6/2003 |
| JP | 2004148442 | | | 5/2004 |
| JP | 2004-298989 | | | 10/2004 |
| JP | 2006175536 | | | 7/2006 |
| JP | 2006187817 | A | * | 7/2006 |
| JP | 2006334679 | A | * | 12/2006 |
| JP | 2007044837 | A | * | 2/2007 |

* cited by examiner

PRINTING APPARATUS WITH CUTTER HAVING A BLADE INCLUDING A STEP PORTION

CROSS-REFERENCE TO RELATED APPLICATION

The present application claims priority from Japanese Patent Application No. 2007-278736, which was filed on Oct. 26, 2007, the disclosure of which is herein incorporated by reference in its entirety.

BACKGROUND

1. Field

The present disclosure relates generally to technical fields including a printing apparatus capable of performing printing on a print medium.

2. Description of the Related Art

In the related art, there have been proposed a variety of tape printing apparatuses of the type in which a roll sheet holder with a lengthy roll sheet wound thereon is removably stored. In a tape printing apparatus of this type, the roll sheet wound on the roll sheet holder is drawn out and transferred by the driving of a platen roller, print data such as characters and graphics are printed with a thermal head that is pressed to the platen roller. The printed roll sheet is cut off by a cutting mechanism into a desired length, and the cut-off sheet is discharged from a sheet discharge port to the outside.

As a cutting mechanism, a so-called "guillotine cutter" including a stationary blade and a movable blade is known. The stationary blade is provided along a full width of a width direction on one side of the roll sheet. The movable blade slides relative to the stationary blade and, concurrently, moves along the thickness direction of the roll sheet. The roll sheet that is cut by the guillotine cutter is formed of, for example, a release paper sheet which is releasably adhered to the reverse face of the sheet via an adhesive. When the roll sheet is cut off, however, there may occur a case in which the adhesive adheres to the movable blade. In this case, for example, the cut-off sheet is jammed due to the adhesive stuck to the movable blade, and hence part of a previously cut-off sheet may be cut off again at the time of cutting off a subsequent sheet. As a technique to prevent such a case, there is known a sheet cutter in which a non-stick coating is applied on a blade material, thereby making it possible to prevent the adhesive from adhering to the blade material (see Japanese Patent Application Laid-Open Publication No. 2000-190280, for example).

SUMMARY

However, in the case of the sheet cutter using the blade material on which the coating film is formed as disclosed in Japanese Patent Application Laid-Open Publication No. 2000-190280, the adhesive is less adherent to the blade material itself, but the coating blunts the sheet cutter. Consequently, there occur the cases in that, for example, a cut-end portion of the sheet is not straight but irregular, and the adhesive stretching in a thread-like form adheres to the cut end portion.

It is one object of the present disclosure to provide a printing apparatus capable of preventing a cut print medium from adhering to a stationary blade or a movable blade without reducing a cutting capability of a cutting edge of the blade.

According to first aspect of the present disclosure, there is provided a printing apparatus includes a transfer mechanism that transfers a print medium including an adhesive layer, a printing device that prints on the print medium transferred by the transfer mechanism, a stationary blade that is provided on a downstream side in a transfer direction of the print medium further than the printing device and that is provided along a width direction of one side of the print medium to cut the print medium, a movable blade that is provided on a downstream side in a transfer direction of the print medium further than the printing device and that cut the print medium by abutting against the other side of the print medium in the width direction and then by moving in a thickness direction of the print medium while sliding over the stationary blade, and a step portion that, where one blade of the stationary blade and the movable blade located on an upstream side in the transfer direction of the print medium is used as an upstream blade and the other blade located on a downstream side in the transfer direction of the print medium is used as a downstream blade, is provided on a reverse face of the downstream blade, the reverse face being reverse of a slide face of the downstream blade sliding on the upstream blade, and that projects along a thickness direction of the downstream blade.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

A tape printing apparatus 1 of one embodiment according to the present disclosure will be described below with reference to the drawings. The tape printing apparatus 1 of the present embodiment stores therein a roll sheet 3A which is a rolled-state print medium, prints characters and graphics etc. on the medium, cuts off it into a desired length, and discharges the cut off sheet.

First, a general configuration of the tape printing apparatus 1 will be described with reference to FIGS. 1 to 7. It is assumed that, the righthand, lefthand, bottom, and upper (depth) sides of FIG. 2 respectively correspond to the righthand, lefthand, front, and rear sides of the tape printing apparatus 1.

Figure 1:
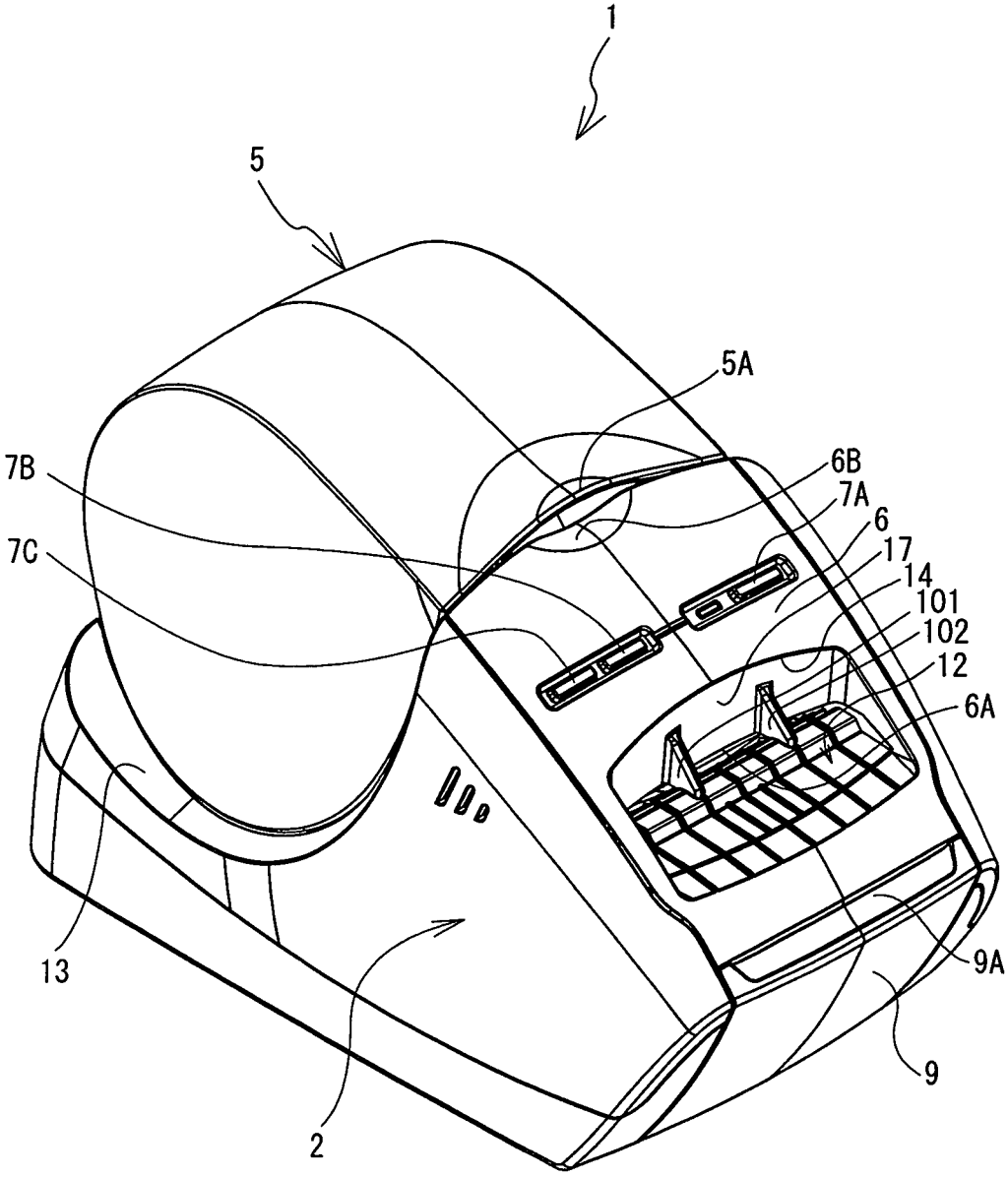
FIG. 1 is a front perspective view of a tape printing apparatus.
Figure 2:
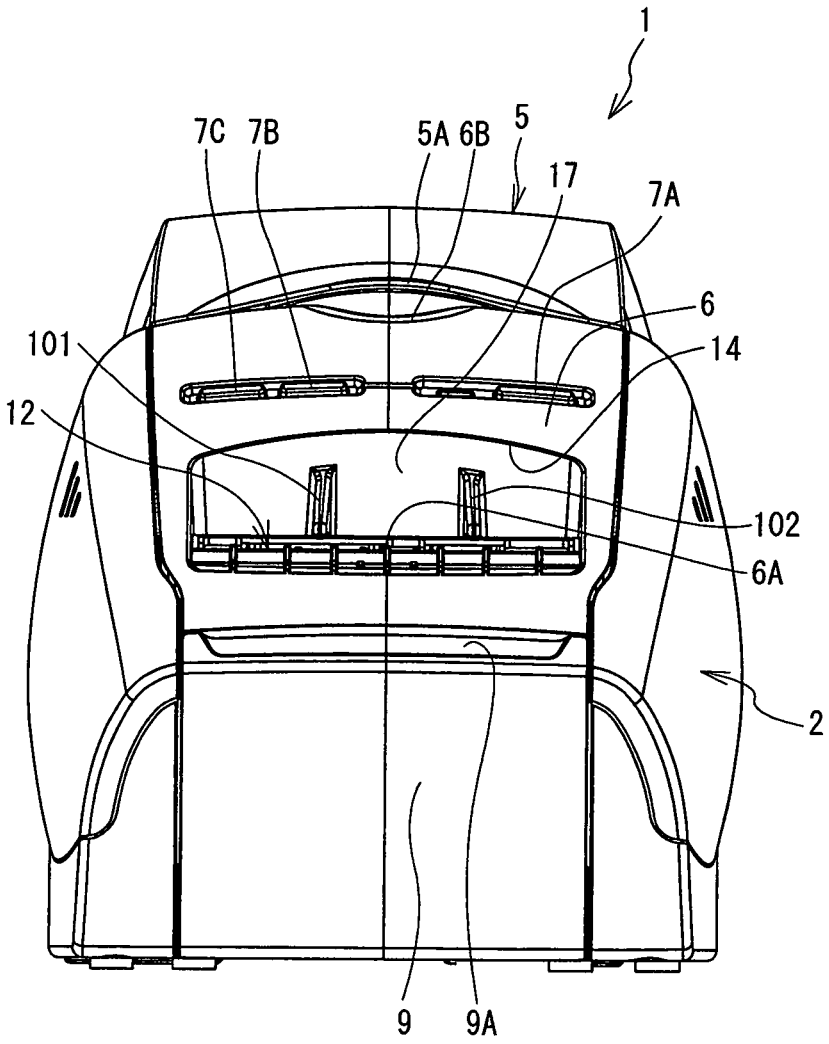
FIG. 2 is a front view of the tape printing apparatus.
Figure 3:
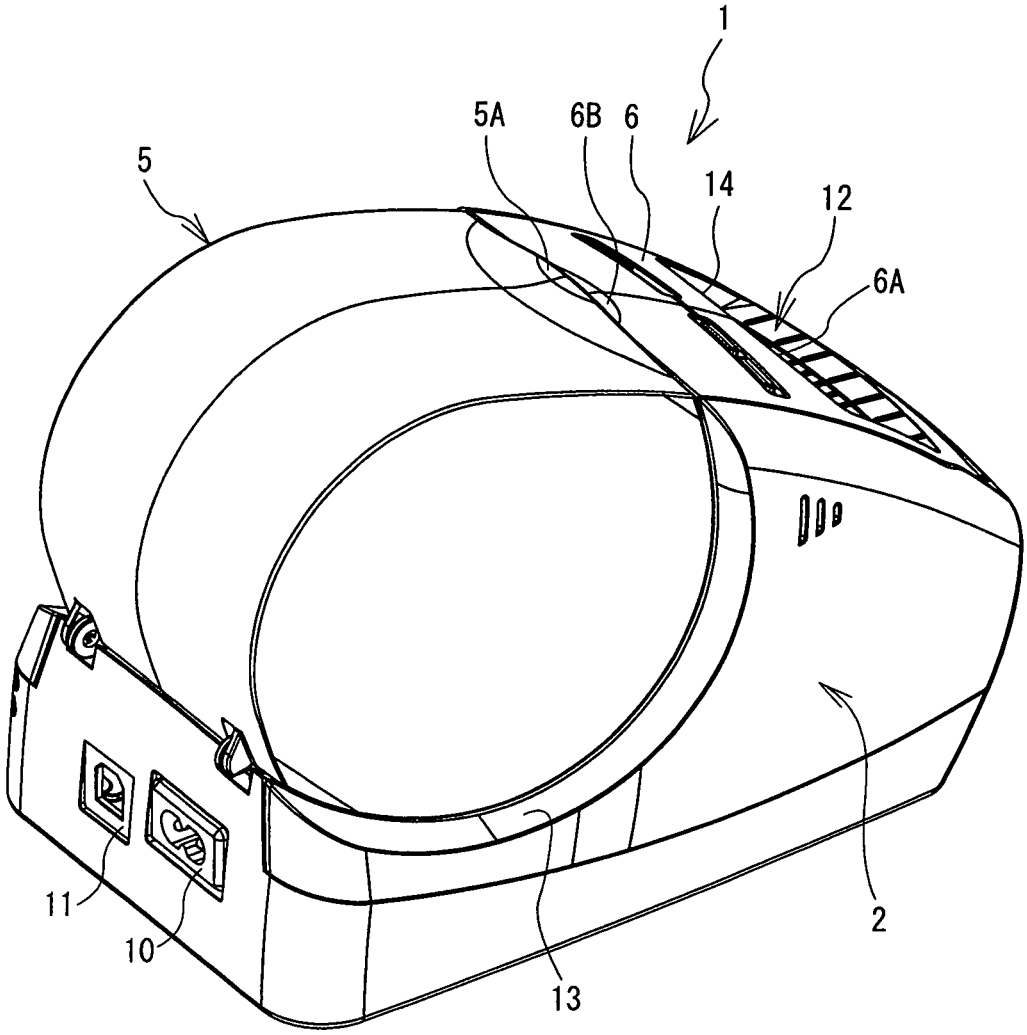
FIG. 3 is a rear perspective view of the tape printing apparatus.

With reference to in FIGS. 1 to 3, the tape printing apparatus 1 includes a body case 2 formed of a resin. A roll sheet holder storage portion 4 (see FIG. 4) having a "U" shaped curve in the side view is provided in a rear upper portion of the body case 2. As shown in FIG. 5, a roll sheet holder 3 is attached to the roll sheet holder storage portion 4. The roll sheet holder 3 on which a roll sheet 3A having a predetermined width is wound and held. A top cover 5 having a substantially semicircular shape in the side view and formed of a transparent resin is attached to an upper end edge portion on the rear side of the body case 2. The top cover 5 is thus attached to be openable and closable (see FIGS. 1 and 4) and in such a manner as to cover the roll sheet holder storage portion 4.

As shown in FIGS. 1 and 2, a resin front cover 6 for covering the front side of the body case 2 is provided on the front side of the top cover 5. An opening portion 14 having a substantially rectangular shape in the front view is provided in the center of the front cover 6. A sheet discharge port 6A for discharging the printed roll sheet 3A is provided substantially horizontally on a central depth of the opening portion 14. An inner wall 17 extending downward to the sheet discharge port 6A is provided in an upper edge portion of the opening portion 14. Holding ribs 101, 102 protruding frontward are provided on a front face opposing the outside of the inner wall 17. The holding ribs 101, 102 press the roll sheet 3A discharged from the sheet discharge port 6A from above, and are provided in the form of a pair of triangular plates in the side view. A stage 12 extending frontward is provided on the front side of the sheet discharge port 6A. The stage 12 is a resin plate including multiple ribs 97, 98 on an upper face thereof, and has a substantially rectangular shape in the plan view. According to the configuration described above, the roll sheet 3A discharged from the sheet discharge port 6A is pushed out onto the stage 12 while being held down from above by the holding ribs 101, 102 to thereby maintain its substantially horizontal state.

As shown in FIG. 1, a power button 7A, a cut button 7B, and a feed button 7C are disposed in a substantially horizontal alignment on an upper side of the opening portion 14. The cut button 7B causes driving of a after-mentioned cutter unit 8 (see FIG. 6) provided in the inner side of the sheet discharge port 6A, thereby to cut the roll sheet 3A. The feed button 7C causes discharging the roll sheet 3A along a sheet transfer direction.

As shown in FIGS. 1 and 2, a resin tray member 9 having a substantially rectangular shape in the front view is provided to be openable and closable on a front side of the front cover 6 and on a lower front side of the body case 2. A lower portion of the tray member 9 is axially supported in a lower front portion of the body case 2. A concave portion 9A is formed on an upper end edge portion of the tray member 9. A user can open the resin tray member 9 frontward by pivotally operating with a finger of the user placed on the concave portion 9A. Thereby, a cut piece of the roll sheet 3A discharged from the sheet discharge port 6A can be accumulated on the tray member 9.

As shown in FIG. 3, an inlet 10 to be connected with a power cord (not shown) is provided in a back wall portion of the body case 2. A USB connector 11 (USB: Universal Serial Bus) to be connected with a personal computer etc. is provided adjacent to the inlet 10.

Figure 4:
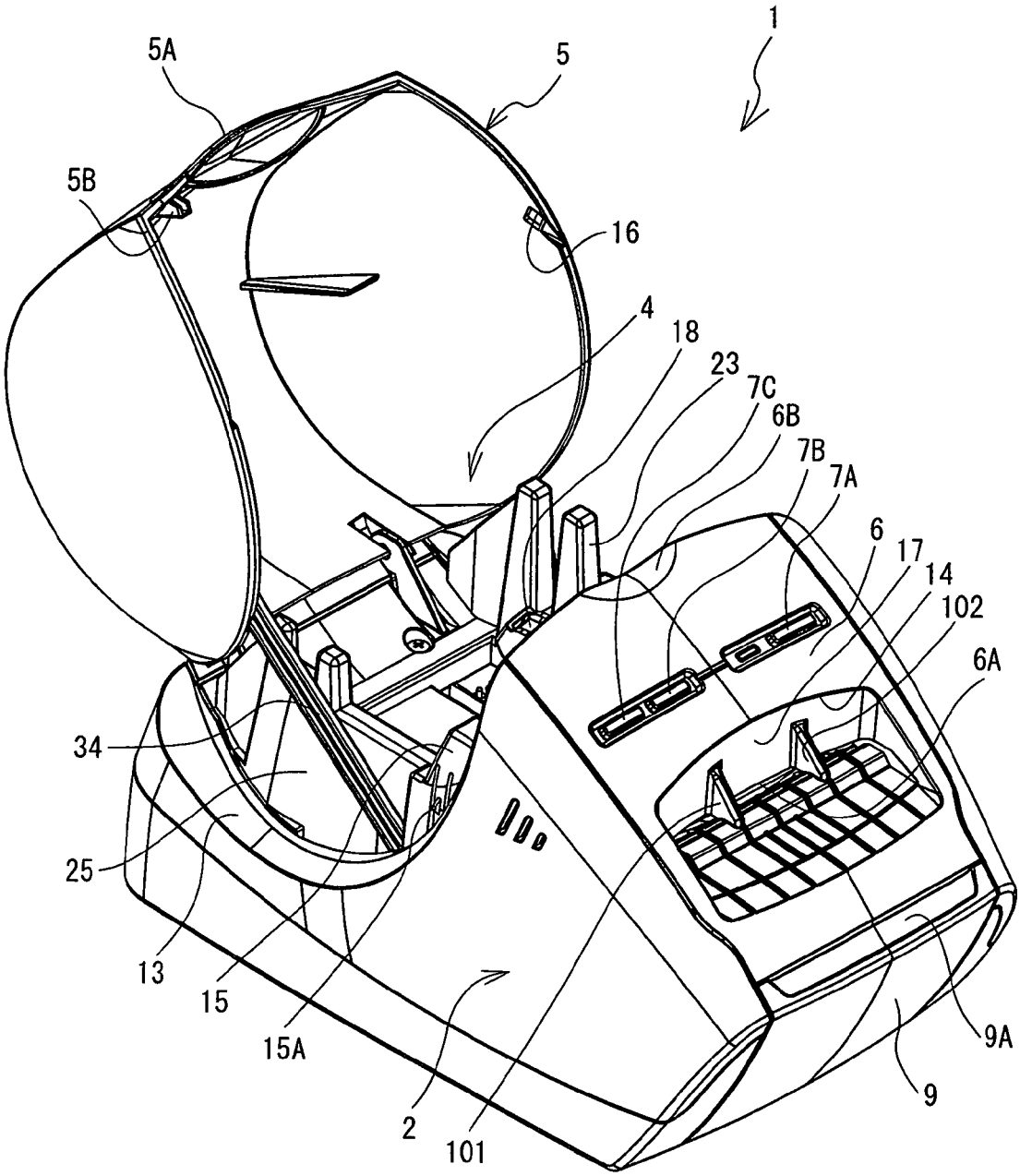
FIG. 4 is a perspective view of the tape printing apparatus in the state where a top cover thereof is open.
Figure 5:
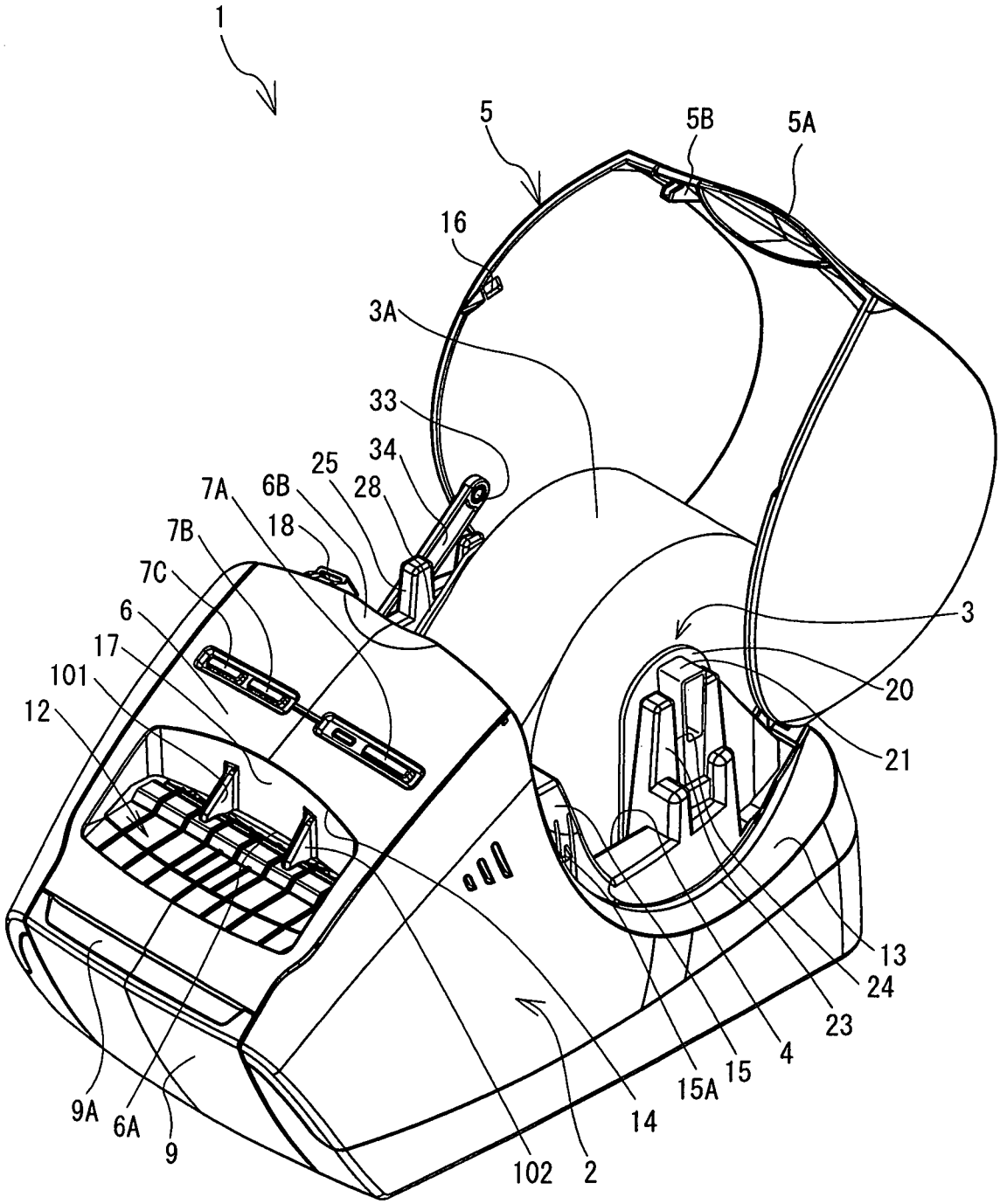
FIG. 5 is a perspective view of the tape printing apparatus in the state where a roll sheet holder is attached thereto.

As shown in FIGS. 4 and 5, housing lateral-wall step portions 13, 13 gradually sloping downward to the outside are provided respectively in left and right lateral edge portions of the body case 2 against which open ends of the top cover 5 abut. Elastic engaging pieces 15, 15 formed to be inwardly elastically deformable are provided on front sides of left and right lateral wall portions of the roll sheet holder storage portion 4.

Engaging protrusions 15A, 15A each having a lateral-section triangular shape and outwardly protruding are formed, respectively, on outer faces of the elastic engaging pieces 15, 15. The engaging protrusions 15A, 15A, respectively, engage with engagement concave portions 16, 16 (which are respectively shown in FIGS. 4 and 5) formed on two edge portions on the opening side of the top cover 5. More specifically, the elastic engaging pieces 15, 15 engage with the respective engagement concave portions 16, 16 when the top cover 5 is pivotally moved to the front side direction and the engaging protrusions 15A, 15A contact with the housing lateral-wall step portions 13, 13. Hence, the top cover 5 is held in the closed state.

As shown in FIG. 1, a finger placing portion 5A which has a gradual upward (outward) curvature is provided in the center of the front edge portion of the top cover 5. According to the configuration, when the top cover 5 is pivotally moved backward with the user's finger placed on the inner side of the finger placing portion 5A, the engagement between the elastic engaging pieces 15, 15 and the engagement concave portions 16, 16 is released. A concave portion 6B which has a gradual downward curvature is formed in a central portion in the upper edge portion of the front cover 6 opposing the finger placing portion 5A. According to this configuration, since the user is able to easily snag his/her finger on the inner side of the finger placing portion 5A, thereby being able to easily open the top cover 5.

As shown in FIGS. 4 and 5, a push tab portion 5B is provided protrudingly on a front left side of the finger placing portion 5A. Further, a top cover detection switch 18 is provided on a predetermined position at the body case 2 that opposes the push tab portion 5B when the top cover 5 is closed. The top cover detection switch 18 determines whether the top cover 5 is closed. The top cover detection switch 18 includes a microswitch, for example. By detecting whether being depressed by the push tab portion 5B, the top cover detection switch 18 determines whether the top cover 5 is closed.

Figure 6:
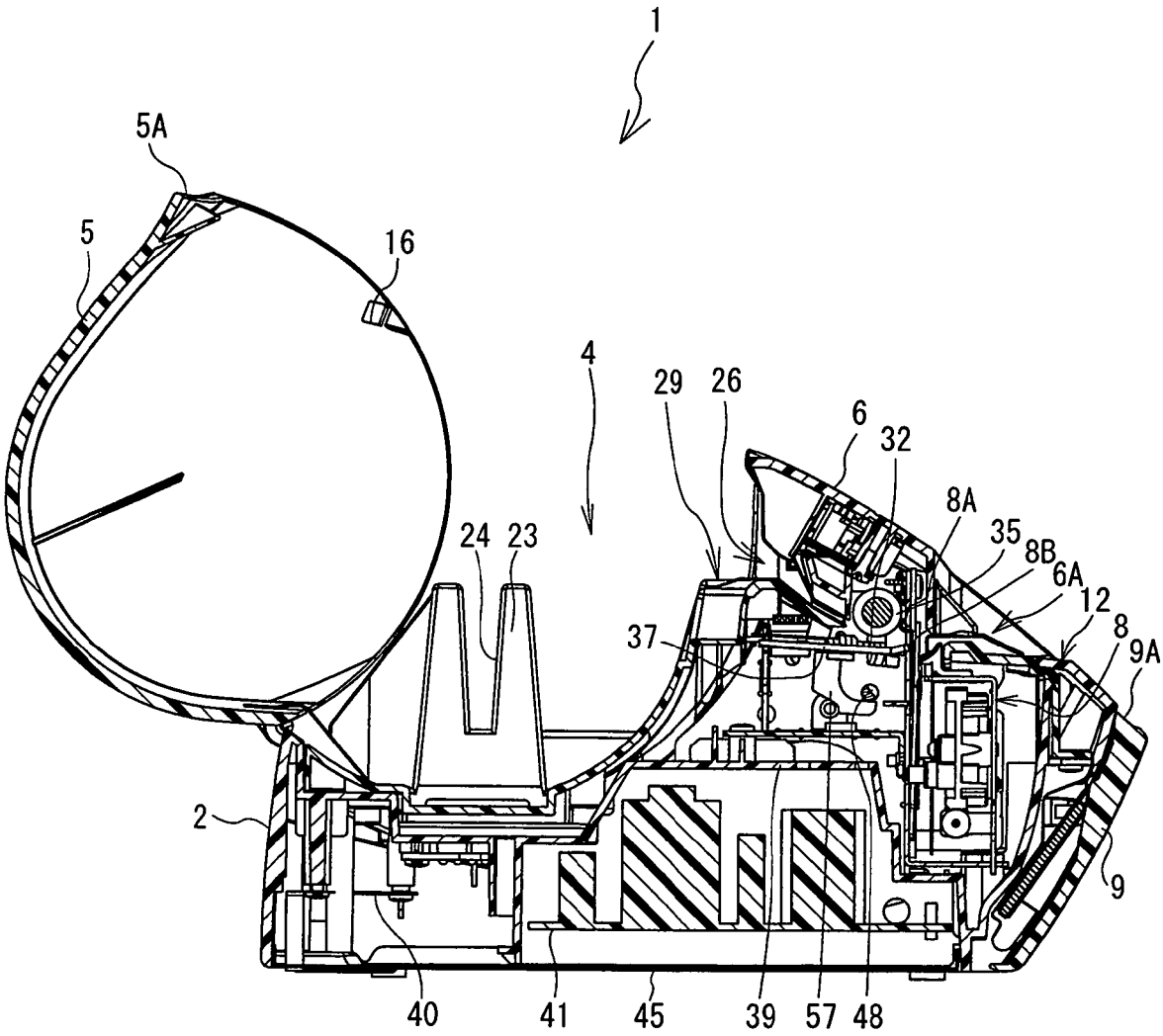
FIG. 6 is a vertical cross-sectional view of the tape printing apparatus.

As shown in FIGS. 5 and 6, a columnar holder support member 23 for supporting the roll sheet holder 3 is provided in a right edge portion of the roll sheet holder storage portion 4. Further, in such a manner as to oppose the holder support member 23, a partition wall 25 is provided in a left edge portion of the roll sheet holder storage portion 4. The holder support member 23 includes a first positioning groove portion 24 formed to have a vertically long "U" shape opening upward in the side view. In the configuration, a mounting member 21 formed into the roll sheet holder 3 is fitted into the first positioning groove portion 24. The mounting member 21 is provided protrudingly on an outer face of a positioning holding member 20, and constitutes the roll sheet holder 3 shown in FIG. 5, and the cross section thereof has a substantially rectangular shape.

Figure 7:
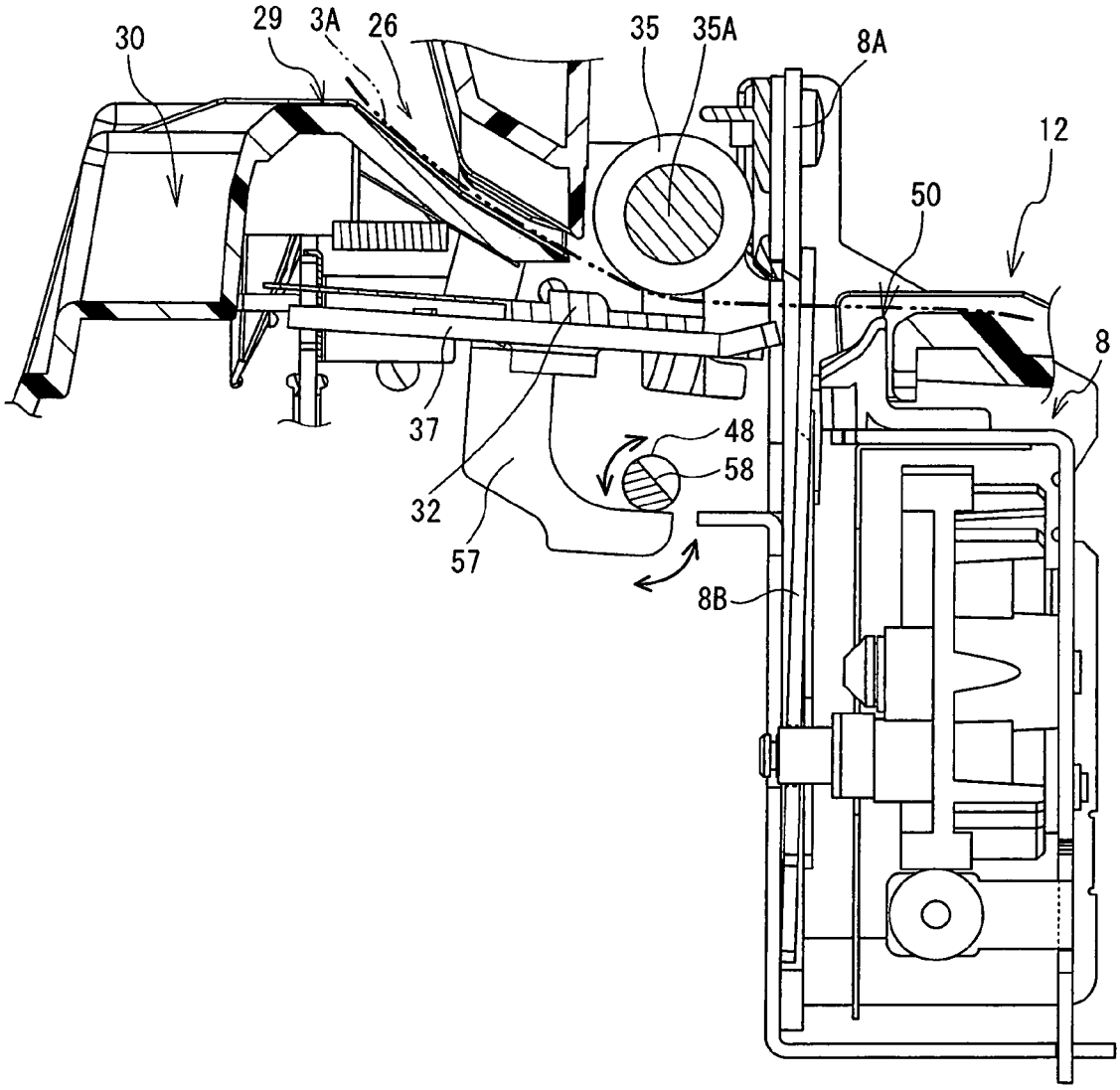
FIG. 7 is an enlarged view of a peripheral portion of a thermal head shown in FIG. 6.

As shown in FIGS. 6 and 7, a mount portion 29 is provided on the front side of the roll sheet holder storage portion 4. The mount portion 29 substantially horizontally extends frontward from the front-side upper end edge portion of the roll sheet holder storage portion 4. A loading port 26 for loading the roll sheet 3A is provided on the upper side of the front edge portion of the mount portion 29. Five second positioning groove portions 30 (one of which is shown in FIG. 7) are respectively provided in the width direction of the mount portion 29 in an end edge corner portion on a transfer direction rear side of the mount portion 29. Each second positioning groove portion 30 has a substantially "L" shape in cross section view, and corresponds to respective width dimensions of plural roll sheets. A leading-end lower end portion abutting on the mount portion 29 of a guide member 28 (see FIG. 5) that constitutes the roll sheet holder 3 is inserted from above. In the configuration thus formed, the roll sheet holder 3 is positioned and mounted in the inner side of the roll sheet holder storage portion 4.

As shown in FIG. 5, an engagement shaft 33 is protrudingly provided in the inner side of the periphery of an opening portion of the top cover 5 and in a position opposing a lateral edge portion on the side opposite to the holder support member 23 of the roll sheet holder storage portion 4. One end portion in the longitudinal direction of a lengthy link lever 34 supporting the top cover 5 is pivotably and removably mounted to the engagement shaft 33. The other end portion of the link lever 34 is coupled to a pivotal mechanism that vertically moves a thermal head 32 (described below) via multiple gears. According to this configuration, the thermal head 32 reciprocates between standby state and press contact state in response to opening and closing of the top cover 5. The thermal head 32 moves apart from the platen roller 35 in the standby state, but press contacts with the platen roller 35 in the press contact state.

An interior mechanism of the body case 2 will now be described hereinbelow. As shown in FIGS. 6 and 7, a sheet transfer path transferring the roll sheet 3A from the loading port 26 to the sheet discharge port 6A is provided. A pivotal shaft 35A of the platen roller 35, which works as a transfer mechanism, is rotatably provided above the sheet transfer path. Further, the thermal head 32 is supported to be contactable with and detachable from the platen roller 35 below the sheet transfer path and in a position opposing the platen roller 35. More specifically, a radiator plate 37 made of metal is fixed to a lower face of the thermal head 32, and is pivotably supported. Hence, the thermal head 32 is contactable with and detachable from the platen roller 35.

The radiator plate 37 is always urged by a compression spring (not shown) so that the thermal head 32 is pressed to the platen roller 35. A lower interference member 57 having a substantially "L" shape in the side view is provided below the radiator plate 37. A leading end of the lower interference member 57 is in contact with one end portion of a release shaft 48. The release shaft 48 rotates in operative association with the pivotal movement of the link lever 34 operatively connected to the top cover 5 (see FIG. 4). One end portion of the release shaft 48 is formed in so-called "D-cutting" so that the shape of the end portion as viewed from the axial direction is a "D" shape. Hence, the one end portion is formed with a cut-out face 58 cut out parallel to the axial direction.

In this structure, when the link lever 34 moves pivotally upon opening/closing of the top cover 5, the release shaft 48 rotates via the pivotal mechanism including the multiple gears (not shown). For instance, when the top cover 5 is opened, the leading end of the lower interference member 57 is urged downward by an outer circumferential surface of one end portion of the release shaft 48. Then, the lower interference member 57 rotates clockwise in the left side view, the thermal head 32 departs from the platen roller 35. Conversely, when the top cover 5 is closed, the leading end of the lower interference member 57 is positioned against the cut-out face 58 of the one end portion of the release shaft 48, and thus the leading end of the lower interference member 57 is not urged downward. Hence, the lower interference member 57 pivots counterclockwise in the left side view via the radiator plate 37 in response to the urging of the compression spring (not shown). In this case, since the thermal head 32 is pressed to the platen roller 35, it enters a print-ready state.

As shown in FIGS. 6 and 7, the cutter unit 8 is provided on the downstream side of the thermal head 32. The cutter unit 8 includes a stationary blade 8A, a movable blade 8B, and a drive motor 19 (see FIG. 9). The stationary blade 8A is disposed above the sheet transfer path. The movable blade 8B opposes the stationary blade 8A, has a "V" shape in the front view, and is disposed under the sheet transfer path. The drive motor 19 is configured by a DC motor and operates to move the movable blade 8B. When the cut button 7B is depressed, the drive motor 19 drives the movable blade 8B to reciprocatingly move it in the vertical direction. Thereby, the roll sheet 3A is cut off between the stationary blade 8A and the movable blade 8B. Then, a cut piece of the roll sheet 3A is discharged from the sheet discharge port 6A. A more detailed configuration of the cutter unit 8 will be described below.

As shown in FIG. 7, a tray base 50 is provided between the cutter unit 8 and the stage 12. The tray base 50 has a substantially "L" shape (in the side view) extending along the width direction of the sheet discharge port 6A. The tray base 50 is a resin member that operates to gently move up a leading end portion of the cut piece of the roll sheet 3A cut off by the cutter unit 8 and then to smoothly push out the cut piece onto the stage 12.

As shown in FIG. 6, a control board 40 is provided via a partition wall 39 under the roll sheet holder storage portion 4. The control board 40 includes, for example, a control circuit that drives and controls respective mechanism portions, such as the thermal head 32, in accordance with instructions issued by an external personal computer or the like. A power supply board 41 including a power supply circuit formed therein is provided under a printing mechanism via the partition wall 39. The printing mechanism is configured to include, for example, the thermal head 32 and the platen roller 35. The thermal head 32 is connected to a connector (not shown) provided on the bottom face side of the control board 40 by way of a flexible flat cable (FFC) (not shown). The control board 40 and the power supply board 41 are covered by a bottom face cover 45 formed of a thin steel sheet and fixed with screws to a bottom face portion.

Figure 8:
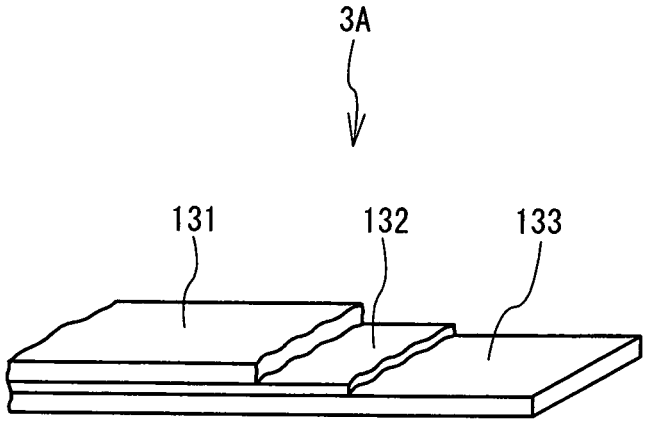
FIG. 8 is a partly cutaway perspective view of a roll sheet.

The roll sheet 3A will now be described herein with reference to FIG. 8. The roll sheet 3A is formed from, for example, a heat sensitive sheet 131, an adhesive layer 132, and a release paper sheet 133. The heat sensitive sheet 131 has an elongated shape. The adhesive layer 132 is formed in such a manner that it is coated overall on one side of the heat sensitive sheet 131. The release paper sheet 133 has an elongated shape and is releasably adhered overall on one side of the heat sensitive sheet 131 via the adhesive layer 132. The roll sheet 3A is an undefined length roll sheet provided for use by being wound and held on the roll sheet holder 3 with a print surface facing inward. In addition, die-cut label sheet of the type in which die-cut labels are releasably adhered on a release paper sheet 133 can be adapted.

The configuration of the cutter unit 8 will be described herebelow with reference to FIGS. 9 to 16.

Figure 9:
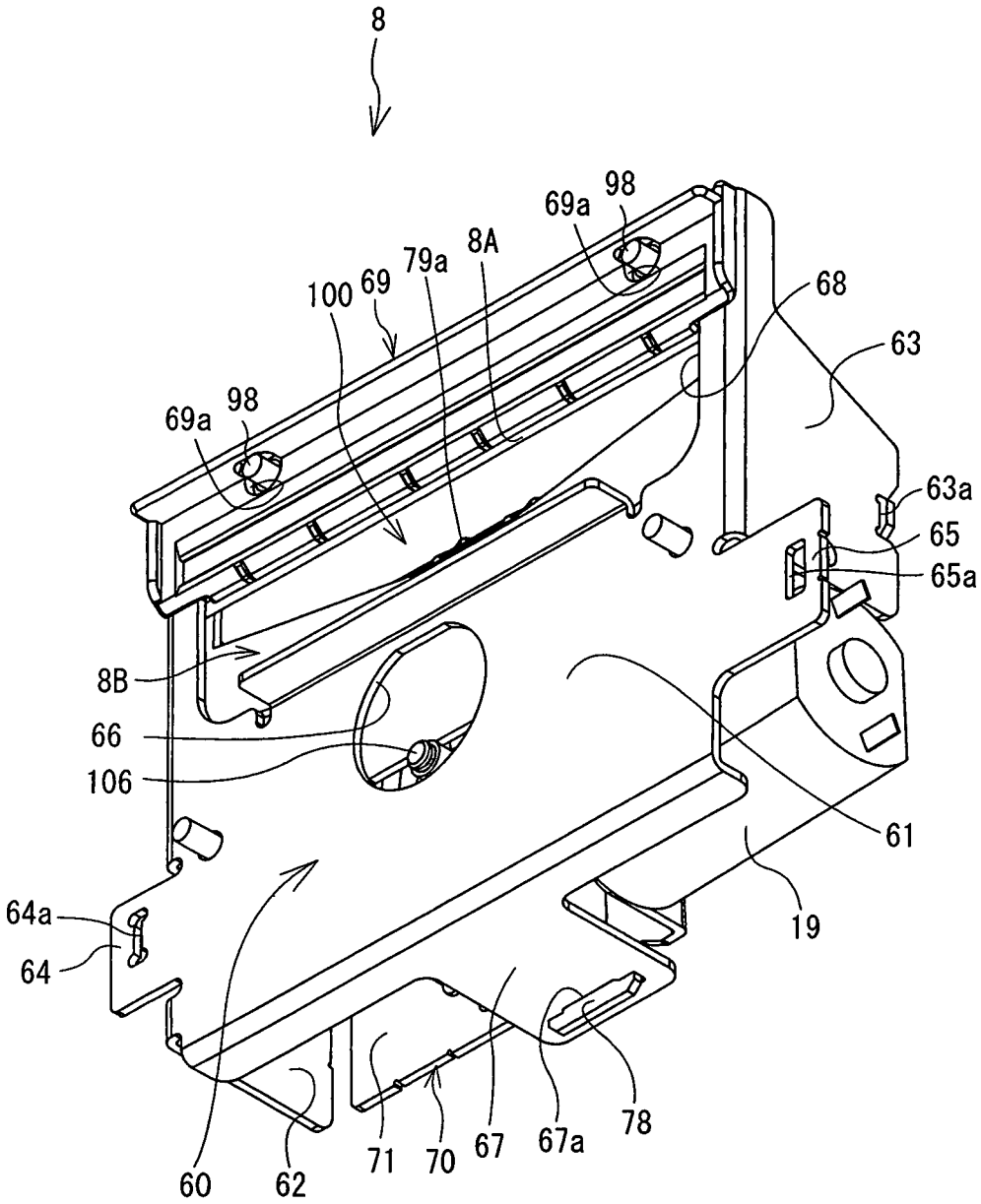
FIG. 9 is a rear perspective view of a cutter unit.
Figure 10:
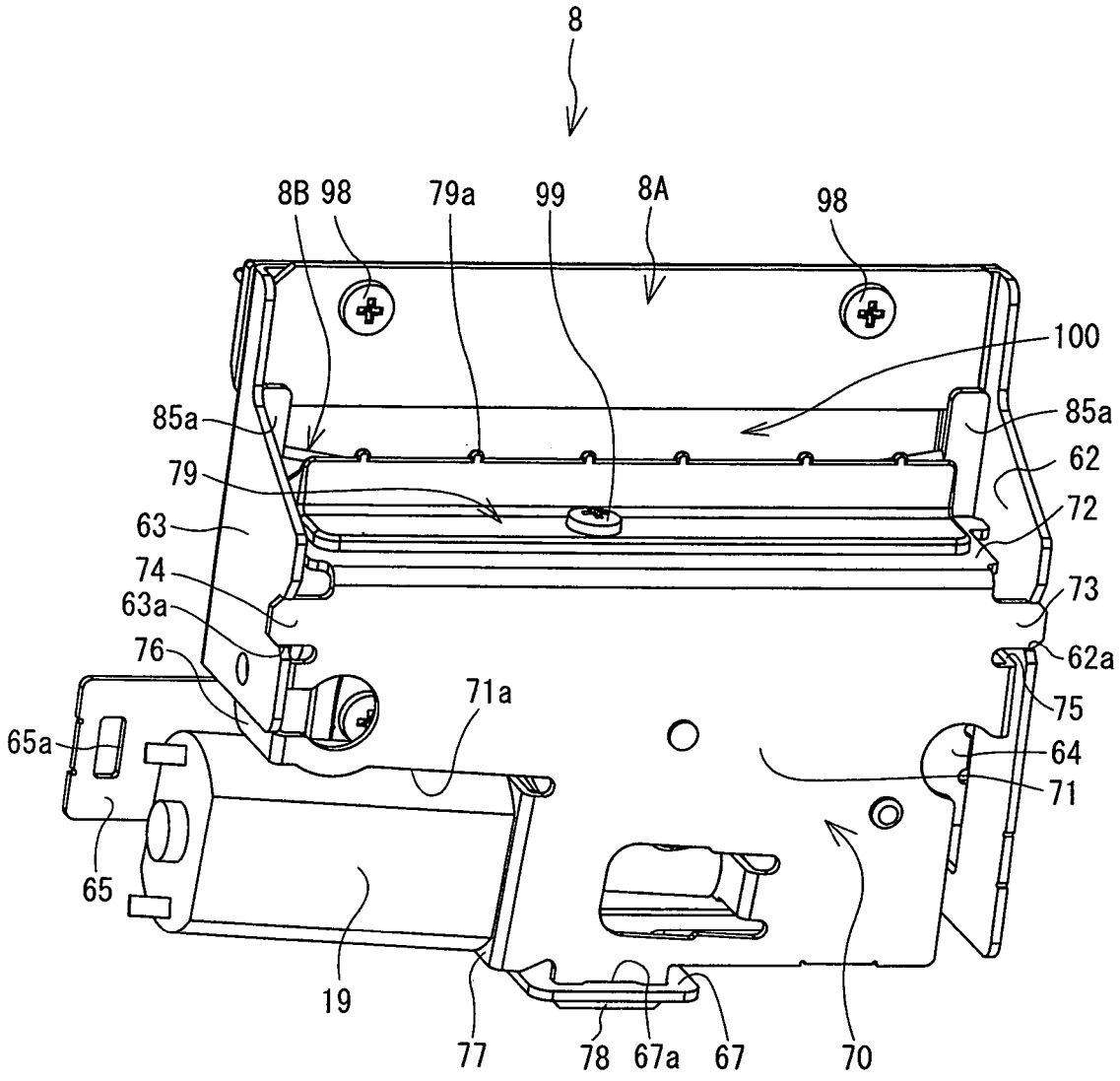
FIG. 10 is a front perspective view of the cutter unit.

As shown in FIGS. 9 and 10, the cutter unit 8 includes a body frame 60, the stationary blade 8A, the movable blade 8B, the drive motor 19, a drive mechanism 105 (see FIG. 12), and a protection frame 70. The body frame 60 is formed of a metal into an "L" shape in the vertical cross section. The stationary blade 8A is fixed to an upper portion of an inner face of the body frame 60, and extends along the width direction of the roll sheet 3A. The movable blade 8B is supported so as to be reciprocatable in the vertical direction from the lower side relative to the stationary blade 8A, and has a "Y" shape in the front view. The drive motor 19 operates to move the movable blade 8B. The drive mechanism 105 operates to move the movable blade 8B in operative association with the driving of the drive motor 19. The protection frame 70 is formed of metal into a reverse "L" in a vertical cross section, and assembled into the body frame 60, thereby to surround and protect the drive mechanism.

First, the body frame 60 will be described hereinbelow. As shown in FIGS. 9 and 10, the body frame 60 includes a body piece 61 having a rectangular shape in the front view. Right sidewall piece 62 and left sidewall piece 63 that are formed to extend in the perpendicular direction are provided in both left and right end portions of the body piece 61, respectively. Engagement concave portions 62*a*, 63*a* are provided in leading end portions of the right sidewall pieces 62 and left sidewall piece 63, respectively. Mounting pieces 64, 65 extending substantially horizontally towards the outside are provided in lower portions of the both left and right end portions, respectively, of the body piece 61. Mounting holes 64*a*, 65*a* are provided in the mounting pieces 64, 65, respectively. The mounting pieces 64, 65 are used to fix the body frame 60 on the inner side of the body case 2 of the tape printing apparatus 1. A rectangular mounting piece 67 extending perpendicularly to the inner face of the body piece 61 is provided in the center of a lower edge portion of the body piece 61. A mounting hole 67*a* is provided in the mounting piece 67. An insertion hole 68 having a substantially rectangular shape in the front view is provided on the upper side of the body piece 61. The insertion hole 68 is used to insert the roll sheet 3A so that the roll sheet 3A is cut between the stationary blade 8A and the movable blade 8B.

Further, a pair of fixing holes (not shown) for fixing the stationary blade 8A is provided in an upper portion of the body piece 61. A paper guide 69 formed of a resin into a laterally long, rectangular shape in the front view is fixed onto an outer face in an upper portion of the body piece 61. The lower face of the paper guide 69 is formed into a tapered shape to have the function of guiding the roll sheet 3A. More specifically, the paper guide 69 functions in such a manner that the roll sheet 3A transferred upward and ran against a lower face of the paper guide 69 is pushed back downward, and is guided to a correct path. A laterally long hole is provided in a central portion of the paper guide 69, in which, when assembled, a part of the platen roller 35 is released into the hole. In the paper guide 69, fixing holes 69*a*, 69*a* are, respectively, provided in the positions opposing the pair of fixing holes of the body piece 61. A guide hole 66 having a circular shape in the front view is provided substantially in the center of the body piece 61. The guide hole 66 is thus provided so that a moving shaft 106 for vertically moving the movable blade 8B is protruded from the inner side of the body frame 60.

Next, the protection frame 70 will be described hereinbelow. As shown in FIG. 10, the protection frame 70 includes a substantially rectangular body piece 71. A rectangular cut-out portion 71*a* is formed in a lower left corner of the protection frame 70. A support piece 72 having a substantially laterally long, rectangular shape in the plan view that extends towards the body piece 61 of the body frame 60 is provided in an upper end portion of the body piece 71. Further, right engaging piece 73 and left engaging piece 74 each substantially and horizontally extending towards the outside are provided to the upper portions of both left and right end portions, respectively, of the body piece 71. The right engaging piece 73 is pressed into the engagement concave portion 62*a* of the sidewall piece 62 of the body frame 60. The left engaging piece 74 is pressed into the engagement concave portion 63*a* of the left sidewall piece 63 of the body frame 60.

Support pieces 75, 76 extending to the inner side of the protection frame 70 are provided to lower portions of the right and left engaging pieces 73 and 74, respectively. Outer faces of the support pieces 75, 76 are fixed in abutment with the inner faces of the right sidewall piece 62 and left sidewall piece 63, respectively, of the body frame 60. A lower engaging piece 78 extending downward is provided in the center of a lower end portion of the body piece 71. The lower engaging piece 78 is inserted into the mounting hole 67*a* of the mounting piece 67 of the protection frame 70. According to this configuration, the protection frame 70 is assembled into the body frame 60. A support piece 77 is provided in an edge portion of the rectangular cut-out portion 71*a* in the vertical direction. The support piece 77 for abutting against an end portion of the drive motor 19 is provided in such a manner that it is perpendicularly bent towards the inner side of the protection frame 70.

In the protection frame 70, a rib support member 79 having a substantially "L" shape in a cross-section view is fixed on an upper face of the support piece 72 with a screw 99. Multiple ribs 79*a* protruding upward are provided at predetermined intervals in an upper end portion of the rib support member 79. The upper end portion of the rib support member 79 including the multiple ribs 79*a* is located in a position between the cutting edge of the stationary blade 8A and the cutting edge of the movable blade 8B during a standby time. According to this configuration, the roll sheet 3A transferred from the thermal head 32 can be slid over the multiple ribs 79*a* provided on the upper end portion of the rib support member 79. In addition, the roll sheet 3A can be guided between the stationary blade 8A and the movable blade 8B.

Figure 11:
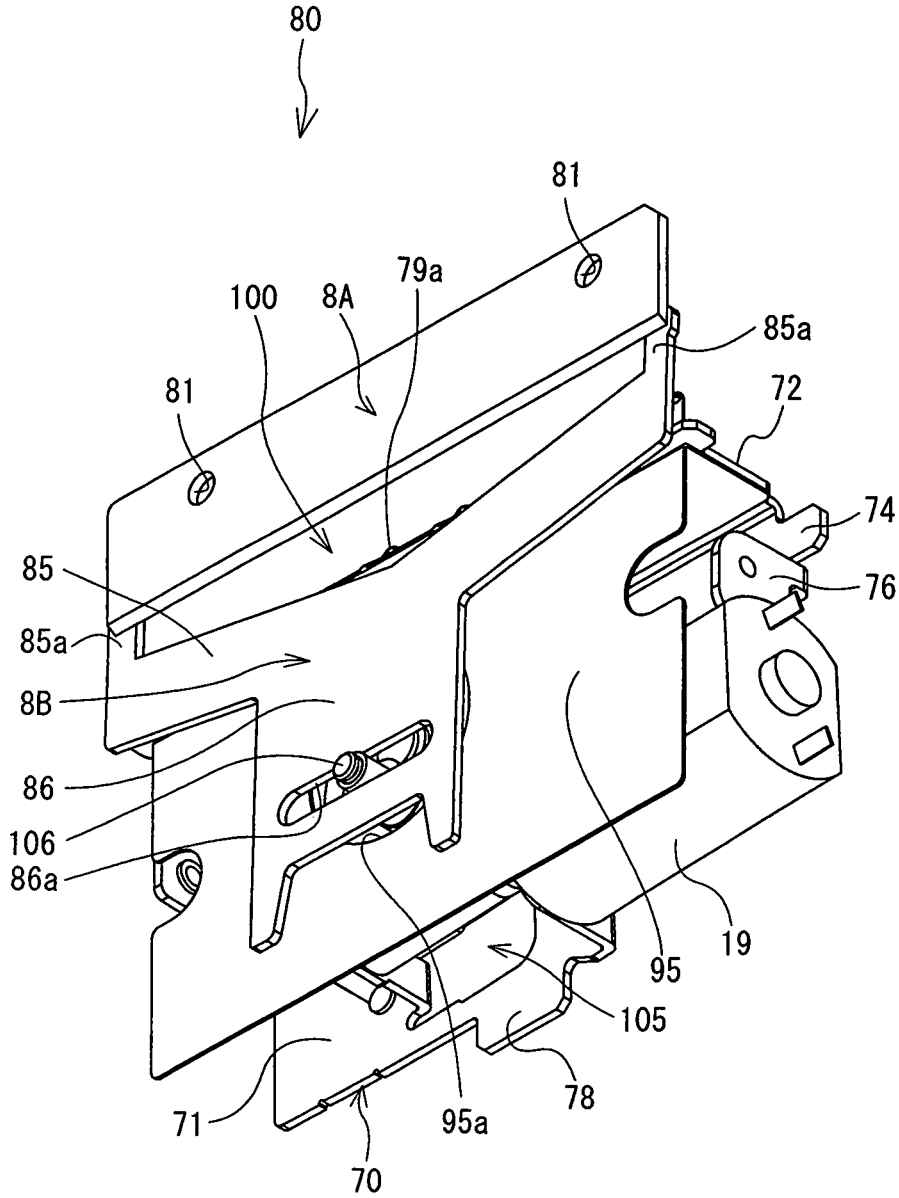
FIG. 11 is a perspective view of a cutter unit intermediate body corresponding to a portion where a body frame is excluded from the cutter unit shown in FIG. 9.

Then, the stationary blade 8A will be described hereinbelow. As shown in FIGS. 10 and 11, the stationary blade 8A is formed into a laterally long, rectangular shape in the front view, and a sharp leading end portion (cutting edge) is directed downward. A tapered face of the leading end portion is directed towards the upstream side in the transfer direction (see FIG. 14). Each of fixing holes 81, 81 is respectively provided on upper portions on both sides in a longitudinal direction of the stationary blade 8A. The stationary blade 8A is aligned with an upper portion of the inner face of the body frame 60, and screws 98, 98 are tightened into the pair of fixing holes 81, 81, respectively. Then, the stationary blade 8A is fixed. In this event, the leading end portion of the stationary blade 8A is positioned on an upper side of the insertion hole 68. A cutter unit intermediate body 80 shown in FIG. 11 is a portion where the body frame 60 is excluded from the cutter unit 8.

Figure 12:
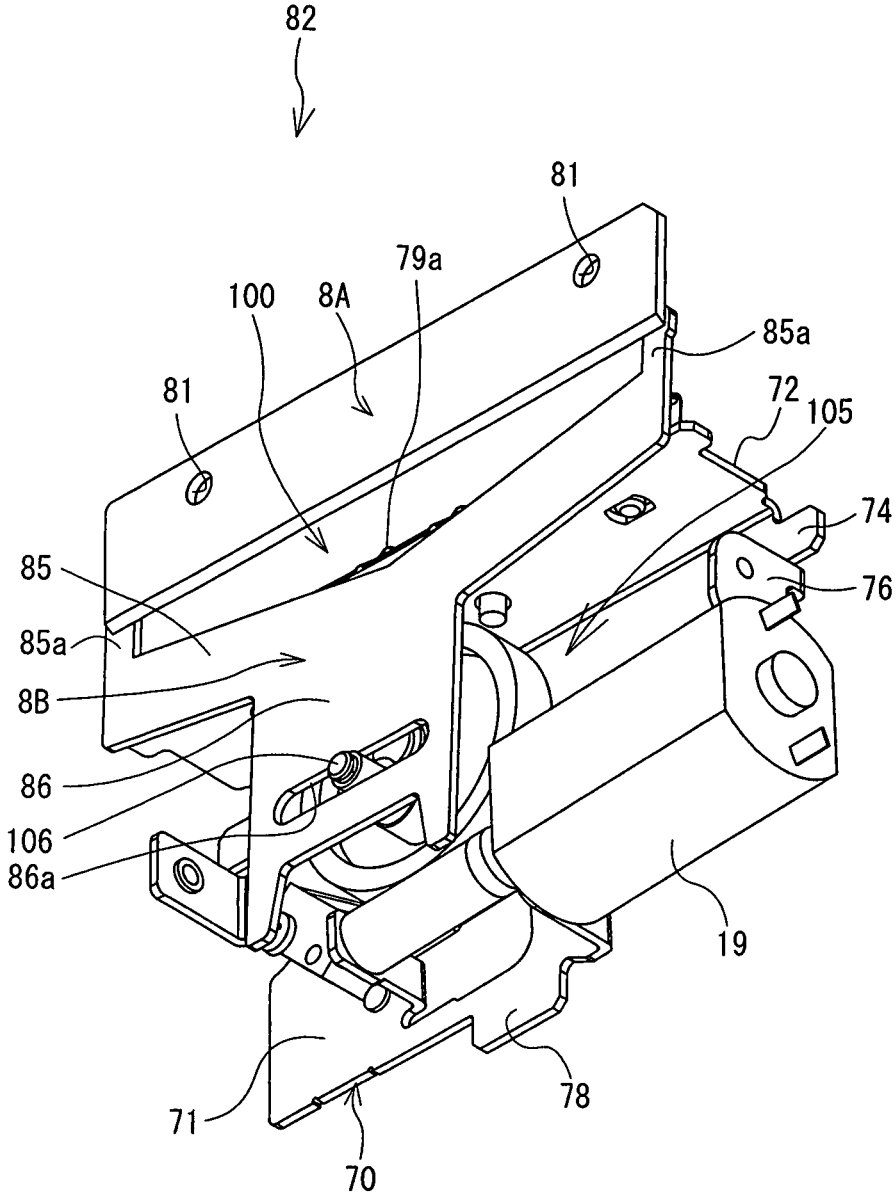
FIG. 12 is a perspective view of a portion where a protection film is excluded from the cutter unit intermediate body shown in FIG. 11.

Next, the movable blade 8B will be described hereinbelow. The cutter unit intermediate body 82 shown in FIG. 12 is a portion where a protection film 95 is excluded from the cutter unit intermediate body 80. As shown in the figure, the movable blade 8B is disposed on the downstream side of the stationary blade 8A in the transfer direction of the roll sheet 3A (see FIG. 14). The movable blade 8B is formed into a "Y" shape in the front view. The movable blade 8B is comprised of a cutting portion 85 and a support portion 86. The cutting portion 85 has a "V" shape in the front view. The support portion 86 has a substantially rectangular shape in the front view, and extends downward from substantially the center of a lower portion of the cutting portion 85. A leading end portion (cutting edge) formed into a sharp angle of the cutting portion 85 of a "V" shape is directed upward. A tapered face of the leading end portion is directed to the downstream side in the transfer direction (see FIG. 14). A cutting gap 100 is formed between the leading end of the stationary blade 8A and the leading end of the movable blade 8B. The roll sheet 3A is transferred to the inner side of the cutting gap 100.

Protrusion pieces 85*a*, 85*a* protruding upward are provided respectively on both sides of the width direction of the cutting portion 85. The protrusion pieces 85*a*, 85*a* slide over a surface of the stationary blade 8A even when the movable blade 8B has moved to the lowermost portion. According to this configuration, the movable blade 8B is stably supported, and the positional relationship with the stationary blade 8A is maintained.

Figure 13:
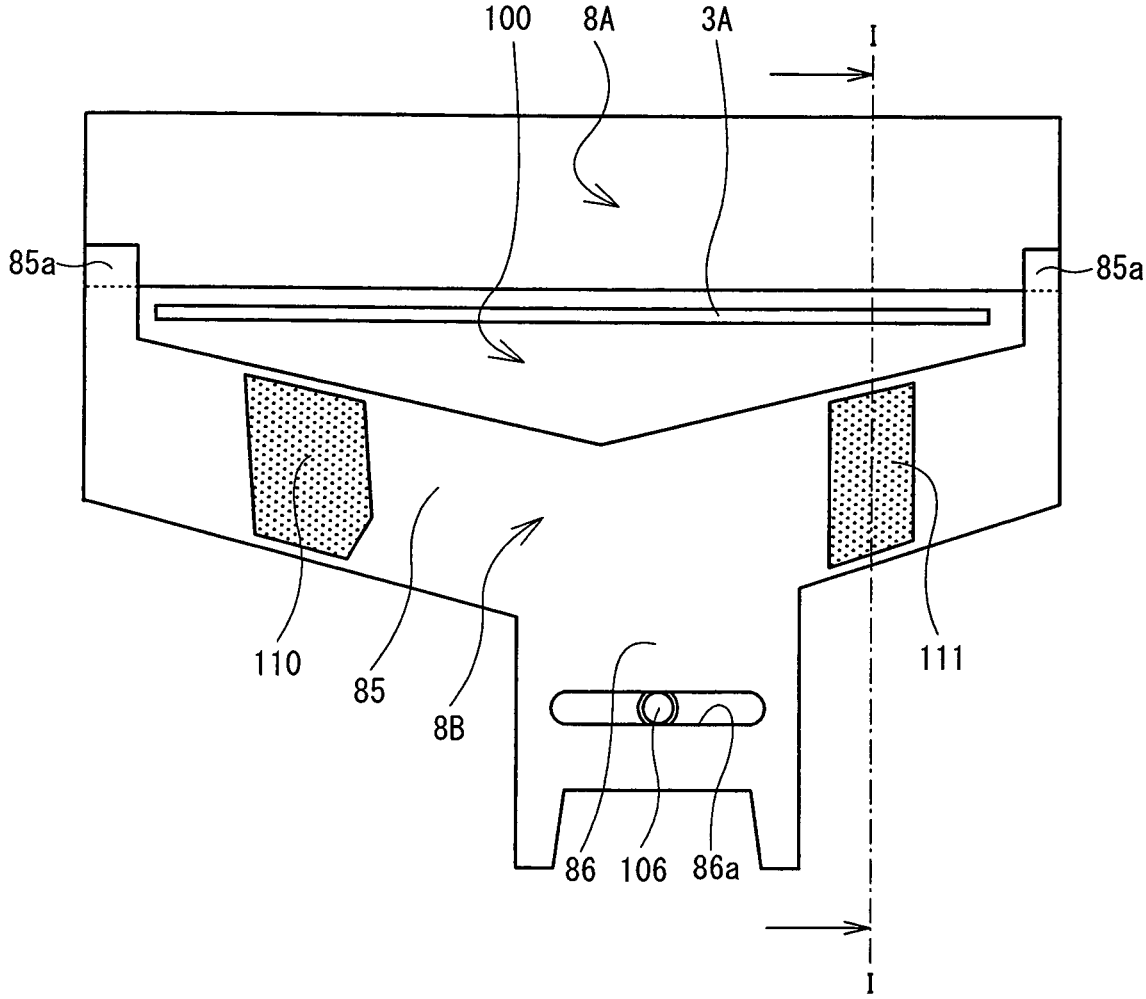
FIG. 13 is a front view of a positional relationship between a stationary blade and a movable blade during a standby time.
Figure 14:
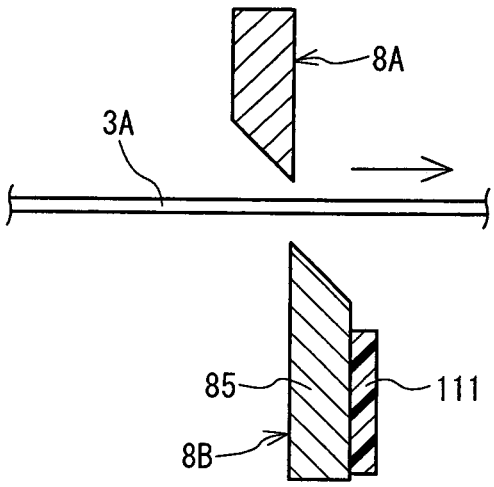
FIG. 14 is an end elevational view taken along line I-I in the direction indicated by arrows in FIG. 13.

As shown in FIGS. 12 and 13, a substantially horizontally long guide hole 86*a* is provided on the side below of the support portion 86. The moving shaft 106, which works to vertically move the movable blade 8B, is inserted into the guide hole 86*a*. The moving shaft 106 is formed to extend in the thickness direction of the movable blade 8B, and is pivotably supported by the drive mechanism 105 that has multiple gears. Hence, upon driving of the drive motor 19, the moving shaft 106 is pivoted by the drive mechanism 105. Then, the moving shaft 106 moves leftward and rightward inside the guide hole 86*a* of the movable blade 8B, and vertically moves the entirety of the movable blade 8B.

As shown in FIG. 13, in the cutting portion 85 of the movable blade 8B with the shape described above, a pair of spacing plates 110, 111 are fixed on a reverse face of a slide face of the stationary blade 8A. The movable blade 8B slides over the slide face of the stationary blade 8A. More specifically, the spacing plates 110, 111 are substantially rectangular resin plates and adhered and fixed in respective central positions in the longitudinal directions of the "V" shaped sides of the cutting portion 85 that extend obliquely upward to the left and right. With the spacing plates 110, 111 provided on the surface of the movable blade 8B, a cut end on the downstream side in transfer direction of the cut roll sheet 3A is slid over the spacing plates 110, 111. According to this configuration, even when the adhesive remains on the cut end of the roll sheet 3A, the cut roll sheet 3A can be forcibly released from the surface of the movable blade 8B. Further, since non-adherent coating does not have to be applied to the movable blade 8B, it does not blunt the movable blade 8B.

Further, the contact area between the cut end of the roll sheet 3A and the spacing plates 110, 111 is preferably reduced in order to prevent the cut end of the roll sheet 3A from adhering onto the surface of the spacing plates 110 and 111. Hence, the spacing plates 110, ill preferably have a shape extending across the width direction of the movable blade 8B on a plane parallel to the surface of the movable blade 8B. According to this configuration, the spacing plates 110, 111 intersect and contact with respect to the cut end of the roll sheet 3A. More specifically, the contact area between the cut end and the spacing plates 110, 111 can be reduced, so that the overall portion of the cut end of the roll sheet 3A can be prevented from adhering onto the surfaces of the spacing plates 110, 111. Further, a crimp treatment is applied on the surfaces of the spacing plates 110, 111. In other words, the surfaces have small depressions and protrusions. According to this configuration, the cut end of the roll sheet 3A is less adherent relative to the surfaces of the spacing plates 110, 111. Further, since the spacing plates 110, 111 are adhered onto the reverse face of the movable blade 8B, they can be mounted easily. Further, the configuration can be formed to have an appropriate size by altering the widths and lengths of the spacing plates 110, 111 according to the size of the roll sheet 3A.

Then, the protection film 95 provided to protect the drive mechanism 105 will be described hereinbelow. As shown in FIG. 12, the drive mechanism 105 operatively coupled to the drive motor 19 is provided in the inner side of the protection frame 70. The drive mechanism 105 includes the moving shaft 106 that vertically moves the movable blade 8B in operative association with the driving of the drive motor 19. The resin protection film 95 having an "L" shape in cross-section view, which is shown in FIG. 11, is disposed between the drive mechanism 105 and the movable blade 8B. The protection film 95 has a shape formed in such a manner that a predetermined width portion on the side of an upper edge of a film having a substantially rectangular shape is substantially horizontally folded back. An upper face of the substantially horizontally folded back portion on the side of an upper edge is fixed with multiple screws (not shown) to the reverse face of the support piece 72 of the protection frame 70 in the state of abutment against the reverse side of the support piece 72. For fixation, a double-sided tape may be used. Further, a guide hole 95*a* having a circular shape in the front view is provided in the center of the protection film 95. The guide hole 95*a* is a hole provided to cause the moving shaft 106 of the drive mechanism 105 to protrude from the inner side of the body frame 60. The protection film 95 thus formed is able to cover the drive mechanism 105 for protection against to the movable blade 8B. More specifically, cut-off scraps of the roll sheet 3A, foreign matters and the like are prevented from invading into the drive mechanism 105.

Figure 15:
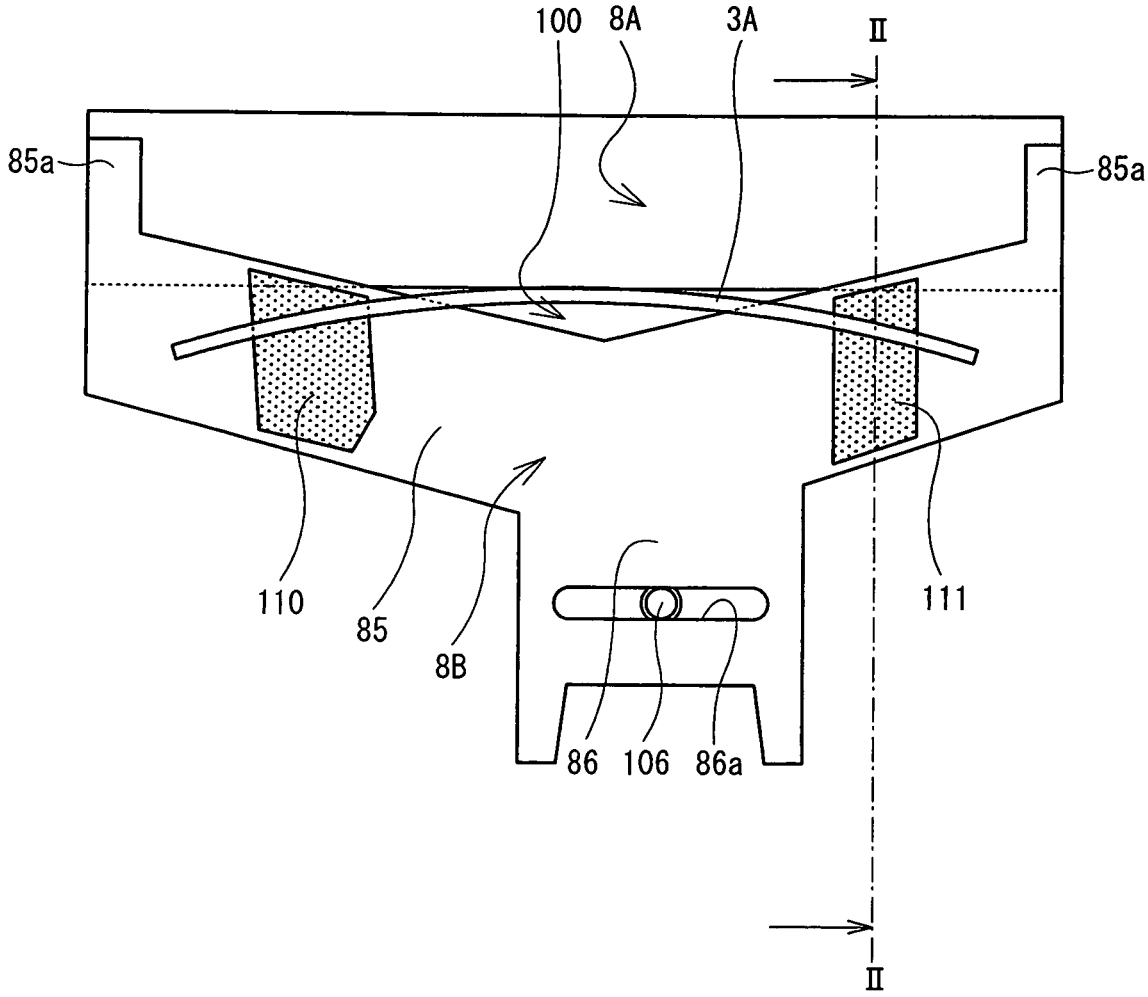
FIG. 15 is a front view of the positional relationship between the stationary blade and the movable blade at the time of cutting.

Next, cutting operation of the cutter unit 8 configured as described above will be described hereinbelow with reference to FIGS. 13 to 16. First, as shown in FIG. 13, during the standby time, the movable blade 8B is disposed in a lowermost position. Then, the roll sheet 3A after being printed is transferred to the cutting gap 100 in the center unit 8 by the rotation of the platen roller 35 (see FIG. 14). Further, the roll sheet 3A after being printed is transferred through rotation and control of the platen roller 35. Thereby, a desired cutting position of the roll sheet 3A is arranged relative to the position where the stationary blade 8A and the movable blade 8B are present. Then, in operative association with the driving of the drive motor 19, the moving shaft 106 of the drive mechanism 105 rotates and moves upward. Then, as shown in FIG. 15, in conjunction with the movement of the moving shaft 106, the movable blade 8B moves upward while sliding over the reverse face of the stationary blade 8A. Then, since the movable blade 8B is formed into a "V" shape, the roll sheet 3A is cut from both sides of the width direction towards the center.

Figure 16:
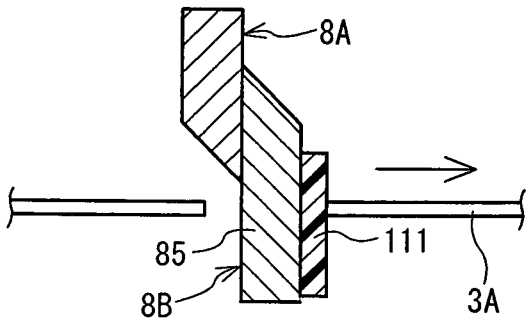
FIG. 16 is an end elevational view taken along line II-II in the direction indicated by arrows in FIG. 15.

In this case, the adhesive protruding from the adhesive layer 132 (see FIG. 8) may remain on the cut end of the roll sheet 3A on the downstream side in the transfer direction. However, as shown in FIG. 16, the cut end of the roll sheet 3A moves upward over the surfaces of the spacing plates 110, 111 via the taper of the leading end of the movable blade 8B. According to this configuration, the cut end of the roll sheet 3A is forcibly released from the surface of the movable blade 8B, so that the cut end of the roll sheet 3A can be prevented from adhering onto the surface of the movable blade 8B. Further, the pair of spacing plates 110, 111, which are provided on both sides of the width direction of the movable blade 8B, abut against the cut end of the roll sheet 3A. Hence, both sides of the width direction of the cut end of the roll sheet 3A can be separated with good balance. Further, since the crimp treatment is applied to the surfaces of the spacing plates 110, 111, the cut end of the roll sheet 3A is less adherable. According to this configuration, the cut end of the roll sheet 3A can easily be released from the surface of the movable blade 8B.

As described above, the tape printing apparatus 1 of the present embodiment includes the cutter unit 8 for cutting the printed roll sheet 3A. The cutter unit 8 includes the planar stationary blade 8A and the "Y"-shaped movable blade 8B that slidingly moves over and in contact with the stationary blade 8A. In the stationary blade 8A, the pair of spacing plates 110, 111 is fixed on the reverse face of the slide face where the movable blade 8B slides over. The spacing plates 110, 111 are substantially rectangular resin plates. With the provision of the spacing plates 110, 111 on the surface of the movable blade 8B, the cut end on the transfer direction downstream side of the cut roll sheet 3A can be slid over the surfaces of the spacing plates 110, 111. More specifically, the cut end of the roll sheet 3A can be forcibly released from the surface of the movable blade 8B. Hence, the adhesive remaining on the cut end can be prevented from adhering onto the surface of the movable blade 8B. According to this configuration, the cut roll sheet 3A can be prevented from being cut again. Further, since the spacing plates 110, 111 are components independent of the movable blade 8B, the spacing plates 110, 111 can be fixed to a conventionally used movable blade. Further, the sizes of the spacing plates 110, 111 can be altered according to, for example, the width and thickness of the roll sheet 3A.

It is noted that, the present disclosure is not limited to the embodiment described above, but various improvements and modifications may be made without departing from the spirit and scope of the disclosure. For example, the spacing plates 110, 111 of the present embodiment are formed of resin, but may be metal plates. Further, the treatment of the surface of the spacing plates 110, 111 is not limited to the crimp treatment, but may be of any type as long as the surface is treated to have an irregular profile having depressions and protrusions.

Further, while the spacing plates 110, 111 are the components independent of the movable blade 8B in the above-described embodiment, step portions projecting in the thickness direction from the surface of the movable blade 8B may instead be formed. Further, the shapes of the spacing plates 110, 111 are not limited to those shown and described in the present embodiment. The spacing plates 110, 111 may preferably be each formed to extend at least in a direction intersecting the width direction of the movable blade 8B in a plane parallel to the movable blade 8B. Further, the number of spacing plates is not limited to two in a pair, but may be one, or two or more.

Further, according to the embodiment described above, the movable blade 8B is disposed closer to the downstream side in the transfer direction of the roll sheet 3A than the stationary blade 8A. However, the positional relationship in the transfer direction between the movable blade 8B and the stationary blade 8A may be reversed. In this case, the step portions (spacing plates) projecting in the thickness direction of the stationary blade BA are provided on a surface on the downstream side in the transfer direction of the stationary blade.

Further, according to the embodiment described above, while, during the standby time, the movable blade 8B is disposed on the side downward of the stationary blade 8A, the positional relationship in the vertical direction between the movable blade 8B and the stationary blade 8A may be reversed.

Further, according to the embodiment described above, the step portions (spacing plates) projecting in the thickness direction of the movable blade 8B are provided only on the surface of the movable blade 8B. However, the step portions (spacing plates) projecting in the thickness direction of the stationary blade 8A may be additionally provided in the thickness direction of the stationary blade 8A. In this case, the cut end of the roll sheet 3A after cutting processing can be prevented from adhering onto the surface of the stationary blade 8A.

The printing apparatus according to the present disclosure is adaptable to a printing apparatus capable of printing on a print medium.

What is claimed is:

1. A printing apparatus comprising:

a transfer mechanism that transfers a print medium including an adhesive layer and a release paper;

a printing device that prints on the print medium transferred by the transfer mechanism;

a stationary blade that is provided on a downstream side in a transfer direction of the print medium further than the printing device and that is provided along a width direction of one side of the print medium to cut the print medium;

a movable blade that is provided on a downstream side in a transfer direction of the print medium further than the printing device and that cuts the print medium by abutting against the other side of the print medium in the width direction and then by moving a thickness direction of the print medium while sliding over the stationary blade, wherein the movable blade has a "V" shape in a front view thereof; and a pair of step portions, comprising at least one step portion disposed on each side of the movable blade in a width direction of the movable blade, and spaced from each other in the width direction of the movable blade;

where the movable blade is disposed closer to a downstream side of the transfer direction of the print medium, and the stationary blade is located on an upstream side in the transfer direction of the print medium; and where the step portions are provided on a reverse face of the movable blade, and that projects along a thickness direction of the movable blade;

where surfaces of the step portion are adapted to slide over a cut end of the print medium on the downstream side in the transfer direction of the print medium; and wherein the step portions each comprise a plate member adhered to the reverse face of the movable blade.

2. The printing apparatus according to claim 1, wherein the step portions extend along a direction intersecting the width direction of the movable blade in a plane parallel to the movable blade.

3. The printing apparatus according to claim 2, wherein a crimp treatment is applied onto a reverse surface of the plate member, the reverse surface being reverse of an adhesion face that is adhered to the movable blade.

4. The printing apparatus according to claim 1, wherein a crimp treatment is applied onto a reverse surface of the plate member, the reverse surface being reverse of an adhesion face that is adhered to the movable blade.

* * * * *